US009834285B2

(12) United States Patent
Orenes Lopez

(10) Patent No.: US 9,834,285 B2
(45) Date of Patent: Dec. 5, 2017

(54) KAYAK

(71) Applicant: ORENES INNOVA, S.L., Beniel-Murcia (ES)

(72) Inventor: Luis Orenes Lopez, Beniel-Murcia (ES)

(73) Assignee: ORENES INNOVA, S.L., Beniel-Murcia (ES)

( * ) Notice: Subject to any disclaimer, the term of this patent is extended or adjusted under 35 U.S.C. 154(b) by 0 days.

(21) Appl. No.: 14/893,333

(22) PCT Filed: May 22, 2013

(86) PCT No.: PCT/ES2013/070324

§ 371 (c)(1),
(2) Date: Mar. 14, 2016

(87) PCT Pub. No.: WO2014/188013

PCT Pub. Date: Nov. 27, 2014

(65) Prior Publication Data

US 2016/0200404 A1 Jul. 14, 2016

(51) Int. Cl.

| | |
|---|---|
| ***B63B 35/71*** | (2006.01) |
| ***B63H 16/20*** | (2006.01) |
| ***B63B 1/04*** | (2006.01) |
| ***B63H 16/08*** | (2006.01) |

(52) U.S. Cl.

CPC ..... *B63B 35/71* (2013.01); *B63B 1/042* (2013.01); *B63H 16/14* (2013.01); *B63H 16/20* (2013.01); *B63H 2016/202* (2013.01)

(58) Field of Classification Search

CPC ..... B63B 35/71; B63B 35/73; B63B 35/00; B63H 16/00; B63H 16/14; B63H 16/18; B63H 16/20; B63H 2016/202

USPC ..... 114/347; 440/26, 27, 29

See application file for complete search history.

(56) References Cited

U.S. PATENT DOCUMENTS

| | | | | |
|---|---|---|---|---|
| 2,735,392 | A | 2/1956 | Cox | |
| 5,460,551 | A | 10/1995 | Beres | |
| 6,231,408 | B1 * | 5/2001 | Lekhtman | B63H 16/14 440/26 |
| 7,037,149 | B1 * | 5/2006 | Mauzy | B63H 16/14 440/27 |
| 2008/0060569 | A1 | 3/2008 | Howard et al. | |

FOREIGN PATENT DOCUMENTS

| | | | |
|---|---|---|---|
| CA | 2225851 | A1 | 9/1999 |
| CA | 2246031 | A1 | 2/2000 |
| DE | 408278 | C | 1/1925 |

OTHER PUBLICATIONS

International Search Report dated Feb. 10, 2014 for PCT/ES2013/070324.

* cited by examiner

*Primary Examiner* — Lars A Olson

(74) *Attorney, Agent, or Firm* — Egbert Law Offices, PLLC

(57) ABSTRACT

The invention relates to a kayak comprising a light and stylish hull with a propeller mounted on the underside thereof, said propeller being actuatable by means of pedals mounted in front of and above a seat, the pedals and propeller being connected by means of a transmission that passes through the inside of the hull and below the surface thereof. Two rudders are arranged at the rear.

4 Claims, 3 Drawing Sheets

KAYAK

CROSS REFERENCE TO RELATED APPLICATION

This Application is a 371 of PCT/ES2013/070324 filed on May 22, 2013, application which is incorporated herein by reference.

FIELD OF THE INVENTION

The present invention refers to a kayak, comprising a light hull which delimits a compartment having a seat for one or more occupants, providing the watercraft with the corresponding cockpits for each occupant.

BACKGROUND OF THE INVENTION

The kayak conventionally consists of a light watercraft having a slender hull intended for one or more occupants, being propelled by a double-bladed paddle which is free-hand used by the watercraft occupant, said paddle resting nowhere.

Such a construction of a kayak makes up a watercraft which is broadly used for sport purposes, for example in regatta races in rivers, lakes, etc., due to the effort the operation thereof requires, but which is not applicable as a recreational craft in large bodies of water.

DESCRIPTION OF THE INVENTION

The object of the present invention is a kayak made up in such a way that it demands less effort for it to move along, and above all, which can be operated comfortably by the occupant thereof.

The kayak of the present invention is a water craft intended for one or more users, which is propelled thanks to a propeller actuated by means of pedals, and, simultaneously, by means of a conventional double-bladed paddle. It is a craft designed, as stated, for the combined use of both propelling systems or by means of either of them.

The kayak of the invention comprises a light and slender hull, having a seat intended for one or more users, which is provided with own actuating means, consisting of one or more propellers being actuated via pedal mechanisms arranged in front of each seat.

According to the invention, the kayak hall is provided with a propeller mounted at the bottom of the kayak hull, at the rear thereof, which can be actuated from some pedals mounted in front of and above the seat, said pedals and propellers being associated through a transmission.

The kayak hull of the invention is provided with two rudders being mounted at the rear thereof in symmetrical positions with respect to the median longitudinal plane of said hull, wherein said rudders can be actuated together from a control located at one side of the seat. The transmission between the actuating control and the rudders may be carried out using a transmission cable.

With the aforementioned conformation, the kayak of the invention is similar to a conventional kayak in terms of the general design thereof, based on an elongated hull featuring a slender design, which can also be operated as a conventional kayak by means of a double-bladed paddle, but being also provided with own propelling means (pedals, gear, propeller, . . . ), which can be actuated by the occupant/s of the kayak and which enable to travel long distances with a minimum effort.

According to another characteristic of the invention, the kayak hull forms, behind the seat, a hold which can be accessed through an upper opening that is closed by means of a cover. This opening can have, fixed in the perimeter thereof, a profile, for example of a plastic material, on which the cover is adjusted, said cover made preferably from an elastically deformable plastic material.

According to another characteristic of the invention, the hull forms at the top part thereof, in front of the seat, a recessed area being longitudinally crossed by an intermediate double wall separation, which projects upwardly with respect to the hull surface. The pedals are mounted on this intermediate separation, the double wall passing through the axis thereof and said axis featuring a pinion being solidly fixed thereto that is located between the two walls of the intermediate separation. The propeller is associated to the pinion through a transmission mounted underneath the hull, in a position being retracted with respect to that of the pinion.

In order to achieve the maximum stability of the craft, the kayak hull of the invention makes up, at the lower part thereof, a trilobular cross section, having a main central body and two auxiliary side bodies. The cockpit or cavity for the passenger and the rear hold are located in the main central body. Furthermore, this main central body is limited by a cross sectional plane at the stern and ends in a very slender bow that narrows gradually. The actuating mechanism, made up of the propeller and the pedals, is mounted on the main central body.

The auxiliary side bodies form two rear extensions starting from the cross sectional plane which limits the central body at the rear part thereof, one of the rudders being mounted on each of said extensions. Furthermore, the auxiliary side bodies form front extensions that narrow gradually, and very slender, which run at both sides of the bow of the central body, featuring a lower length than said body itself.

The kayak seat features an adjustable position, this being thereby mounted over longitudinal guides which are integral to the hull.

As it has been indicated before, the pedals are mounted at the front and above the seat surface, in such a way that operation thereof can be carried out in a comfortable position for the occupant of the watercraft, wherein, in order to achieve a higher effect in propelling the craft, a conventional double-bladed paddle can also be used.

BRIEF DESCRIPTION OF THE DRAWINGS

The following drawings show, by way of example, a kayak constituted according to the invention, wherein:

FIGS. 1 to 11 are schematic cross sections of the watercraft, taken according to points 5 to 11 of FIG. 1, to show the evolution of the shapes of the hull.

DETAILED DESCRIPTION OF AN EMBODIMENT

Figure 1:
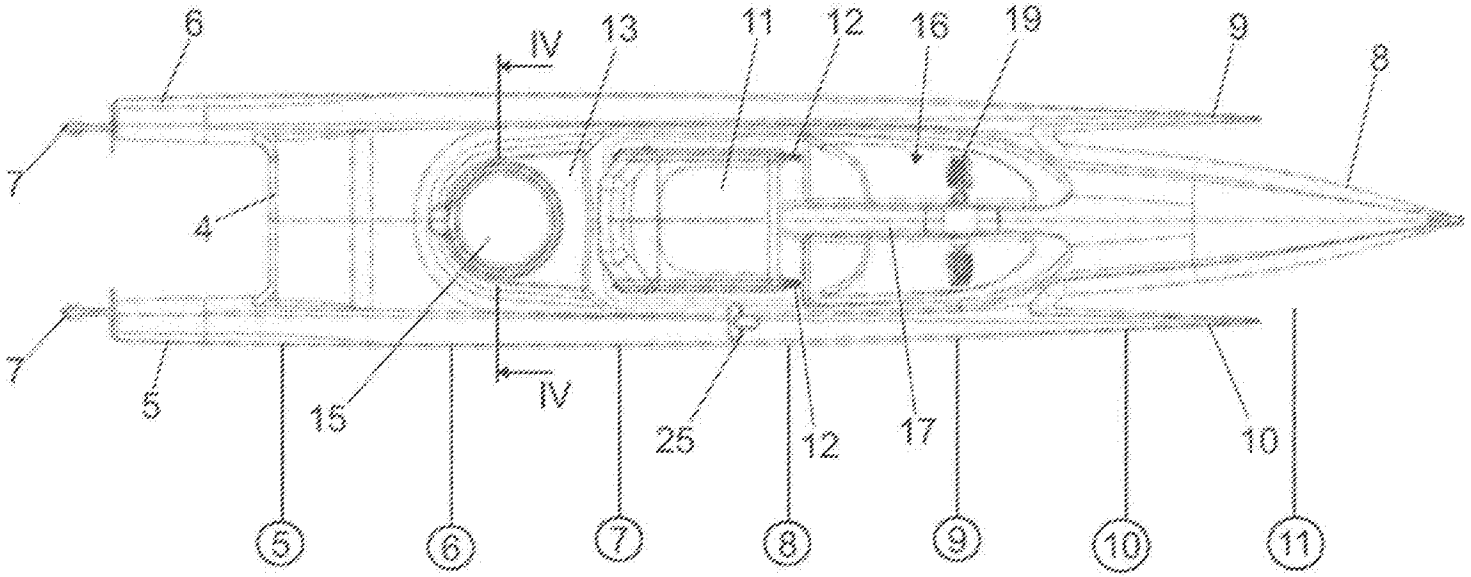
FIG. 1 is a top plant view of the kayak.
Figure 2:
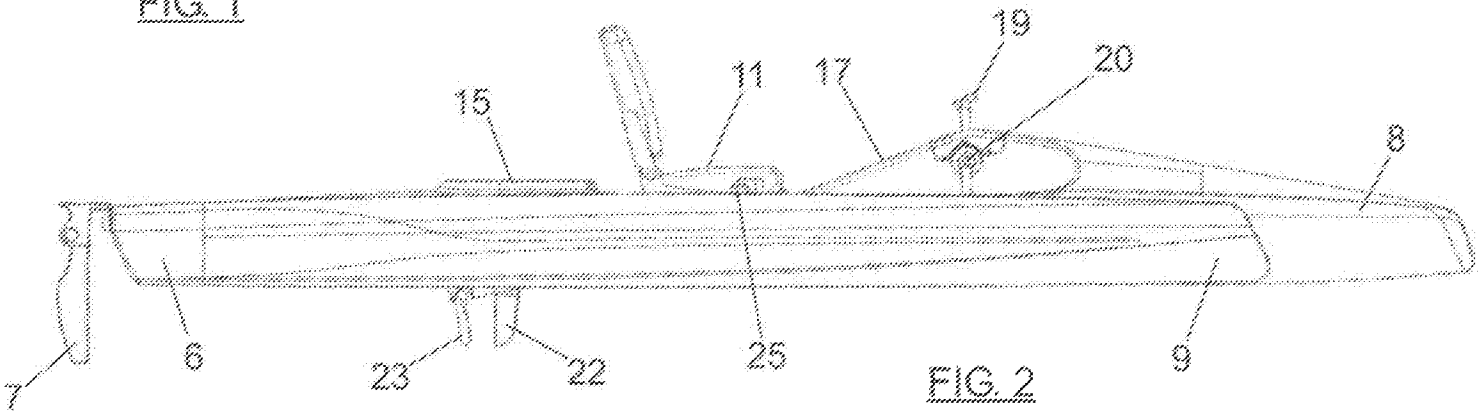
FIG. 2 shows a side elevation view of the same watercraft.

FIGS. 1 and 2 show a plant and a side elevation view of the kayak of the invention, comprising a hull which, as it is represented in FIGS. 5 to 11, forms in the inner area thereof a trilobular cross section, having a main central body (1) and two auxiliary side bodies (2 and 3). The central body (1) features a height approximately constant between sections (9 and 11), whereas the bottom features an upward slope from section 9, reducing the height of said body, ending in a cross sectional plane (4) which limits this central body at the rear thereof. Meanwhile, the auxiliary side bodies (2 and 3) keep an approximately constant height over the entire length thereof and run substantially parallel to each other, extending, from the cross sectional plane (4) limiting the central body (1) at the rear part thereof, in portions (5 and 6) in each one of which there is a rudder (7) mounted, as it can be better appreciated in FIG. 2.

On the other hand, the central body (1) forms a bow (8) that narrows gradually tapering to a point, the two side bodies (2 and 3) forming two front extensions (9 and 10), being substantially parallel, which run at both sides of the bow (8) of the central body, without reaching the end thereof.

The stability of the craft is thus enhanced by means of the lateral bodies (2 and 3).

The central body (1) is provided, at the top part thereof, with an intermediate platform on top of which a seat (11) or more (as many as the number of users the craft is designed for) are mounted by means of longitudinal rails (12) which make it possible to adjust the position of said seat/s.

Figure 4:
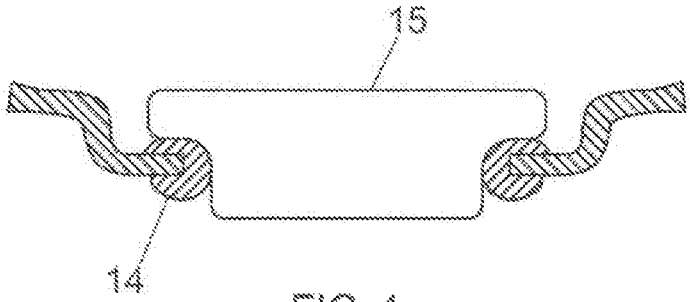
FIG. 4 is a section of the opening giving access to the hold, having a closing cover, taken according to the cutting line IV-IV of FIG. 1.
Figure 5:
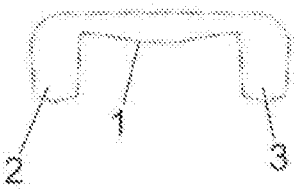
Figure 6:
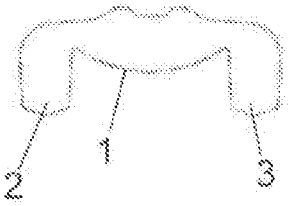
Figure 7:
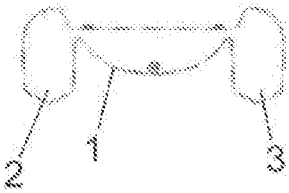
Figure 8:
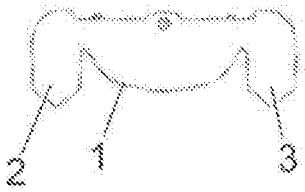

Behind the seat (11) the hull of the central body (1) forms a hold (13) that is provided with an access opening, FIG. 4, in the perimeter of which a ring (14) is mounted, for example one made of a plastic material, over which a closing cover (15) can be adjusted, preferably made of an elastically flexible material.

Figure 9:
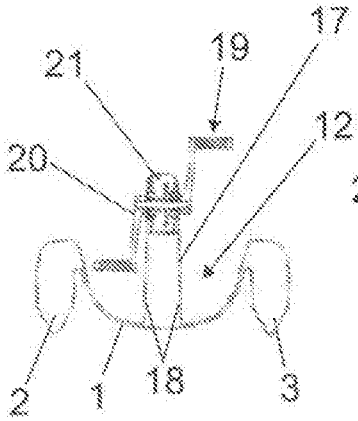
Figure 10:
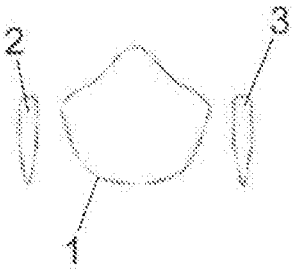
Figure 11:
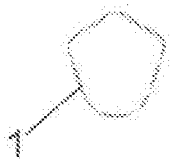

In front of the seat (11) the central body (1) of the craft forms a recessed area (16), FIGS. 1 and 9, which is longitudinally crossed by an intermediate separation (17) featuring a double wall (18). A pedal mechanism (19 is mounted in this intermediate separation, the axis (20) of which passes perpendicularly through the two walls (18), between which the pinion (21) of this pedal mechanism is located.

Figure 3:
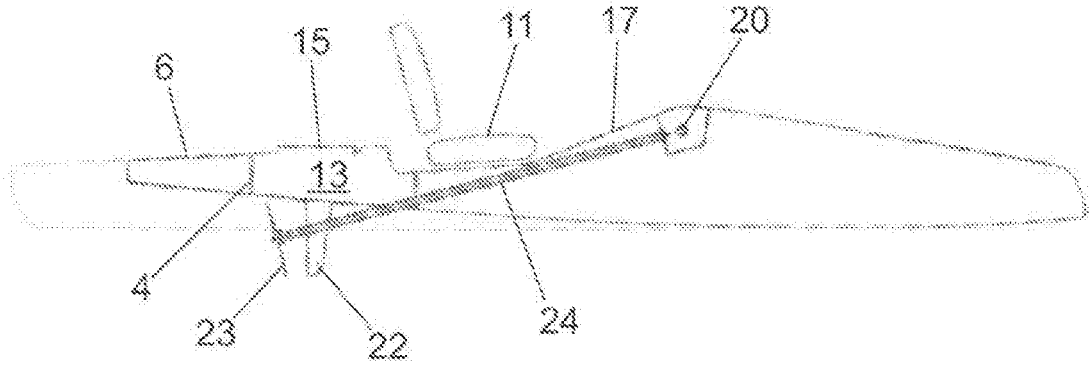
FIG. 3 is a longitudinal schematic section of the kayak, according to the median longitudinal plane thereof.

As it can be seen in FIG. 3, the hull is provided, at the rear part thereof, in the area having a smaller height, with a central projection (22) on which a propeller (23) is mounted, being actuated by the pedal mechanism (19) through a transmission (24) running over the inner area of the intermediate separation (17).

As it can be seen in FIGS. 2 and 3, the pedal mechanism (19) is located in front of and slightly above the seat (11) surface.

The rudders (7) can be actuated by means of a cable, not shown, from a control (25) located at one side of the seat (11), being both rudders (7) actuated together from the control (25).

With such a conformation, the kayak of the invention can be easily actuated by a person situated in a comfortable position on the seat (11) and using the control (25) to control the rudders (7) from an easily accessible location. Furthermore, the kayak of the invention may also be propelled by means of a double-bladed paddle featuring a conventional design and operation.

On the other hand, having a hold (13) with a water-tight cover (15) makes it possible to transport different objects or goods without the risk of them getting wet.

Although in the example represented in the drawings the kayak is provided only with one seat, for a user, the watercraft could be provided with two or more seats, each one having a pedal mechanism associated to the chain or means of transmission for the propeller operation, all that by only increasing the hull length.

The invention claimed is:

1. A kayak comprising:

a hull having a seat for a user;

a propeller mounted at a bottom of said hull at a rear thereof;

a plurality of pedals mounted in front of and above said seat, said plurality of pedals cooperative with said propeller so as to actuate said propeller;

a transmission cooperative with said propeller and said plurality of pedals, said transmission arranged at an inner area of said hull and underneath a surface of said hull;

a pair of rudders mounted at the rear side of said hull, said pair of rudders being symmetrically located with respect to a median longitudinal plane of said hull; and a control positioned at one side of said seat, said control cooperative with a transmission cable that activates said pair of rudders, said hull forming a trilobular cross section at a bottom thereof, said trilobular cross section having a main central body and a pair of auxiliary side bodies, said main central body reducing in depth toward a rear part thereof and delimited at a stern of said hull by a cross-sectional plane, a front part of said main central body ends in a narrowing bow, said pair of auxiliary side bodies forming a pair of rear extensions with respect to said central body, said pair of rudders being mounted on said pair of rear extensions, said pair of auxiliary side bodies forming a pair of front extensions which narrow gradually and run separate from a central body bow without reaching an end thereof.

2. The kayak of claim 1, said hull forming a hold behind the seat which is accessible through an upper opening, said upper opening having a cover that can selectively close said upper opening.

3. The kayak of claim 1, said hull forming a recessed area in front of said seat, said recessed area being longitudinally crossed by an intermediate separation with a double wall projecting upwardly with respect to a surface of said hull and perpendicularly passed through by an axis of said pair of pedals, said pair of pedals having a pinion positioned between walls of said double wall, said transmission running through the walls of said double wall.

4. The kayak of claim 1, said central body having a lower projection at the rear part thereof, said propeller being mounted on said lower projection.

* * * * *